United States Patent [19]

Klein

[11] 4,113,240

[45] Sep. 12, 1978

[54] CONTINUOUS OPEN-ENDED SINTERING FURNACE SYSTEM

[75] Inventor: Gerhart P. Klein, Manchester, Mass.

[73] Assignee: P. R. Mallory & Co. Inc., Indianapolis, Ind.

[21] Appl. No.: 769,369

[22] Filed: Feb. 16, 1977

Related U.S. Application Data

[63] Continuation of Ser. No. 623,173, Jan. 16, 1976, abandoned.

[51] Int. Cl.[2] ..... F27B 5/16

[52] U.S. Cl. ..... 266/252; 75/224

[58] Field of Search ..... 75/227, 224; 198/635, 198/709; 266/252, 255, 257; 29/149.5 PM

[56] References Cited

U.S. PATENT DOCUMENTS

| | | | |
|---|---|---|---|
| 2,061,910 | 11/1936 | Kingston | 266/255 |
| 2,203,895 | 6/1940 | Davis et al. | 29/149.5 PM X |
| 2,928,523 | 3/1960 | Neidhardt | 198/635 |
| 3,290,030 | 12/1966 | Goehring | 266/257 |
| 3,750,864 | 8/1973 | Nolte | 198/707 |

FOREIGN PATENT DOCUMENTS

| | | | |
|---|---|---|---|
| 47-21312 | 3/1972 | Japan | 266/232 |

*Primary Examiner*—Roy Lake
*Assistant Examiner*—Paul A. Bell
*Attorney, Agent, or Firm*—Hoffmann, Meyer & Coles

[57] ABSTRACT

An open-ended continuous sintering furnace and system including means for providing a countercurrent protective gas atmosphere through a portion of the furnace and system and a substantially contaminant-free exit atmosphere throughout the remainder of the system and a continuous conveyor means of substantially solid refractory metal with notched retaining walls. The countercurrent protective gas atmosphere is provided so as to purge volatilized impurities released from workpieces past non-sintered or partially sintered workpieces. Such a flow thereby helps to prevent contamination of more fully sintered workpieces as they are cooled and exit the system. The partial countercurrent protective gas atmosphere is accomplished by multiple gas ejection means for ejecting the protective gas or by multiple sintering chambers with gas ejection between the chambers. Use of a continuous refractory metal conveyor belt means reduces contamination from the belt means to workpieces and allows for higher sintering temperatures due to its high mechanical strength at these temperatures. The belt means also includes retaining walls to prevent workpieces from being displaced from the belt means prior to and during sintering and these retaining walls are notched at regular intervals to provide flexibility when passing over conveyor driving means.

4 Claims, 4 Drawing Figures

CONTINUOUS OPEN-ENDED SINTERING FURNACE SYSTEM

This is a continuation, of application Ser. No. 623,173, filed Jan. 16, 1976 now abandoned.

The present invention relates to a sintering furnace and sintering systems and the process performed therein and, more particularly, to a sintering furnace and sintering systems for the continuous sintering of small workpieces such as tantalum anodes for capacitors.

Sintering furnace systems are almost exclusively used in powder metallurgy sintering processes. Typically, in these processes, blended metal powders and a binder are pressed into compacts of the desired shape. The pressing operation gives the compact sufficient mechanical strength to be selfsupporting. The compact is then introduced into a high temperature sintering zone of the sintering furnace system where further strength is imparted to the compact by heat. It is generally believed that the high heat of sintering fuses the individual powder particles to one another to produce a strong unitary structure. The heat also volatilizes the binder, drives off trapped gases, and may convert any impurities in the compact to gaseous form. Typically the gases that are evolved from workpieces are oxygen, nitrogen, water vapor, metallic impurities and various organic substances. Upon cooling, the sintered compacts may be further processed such as machined to yield the desired shape, treated to provide a capacitor anode and the like.

Since most powdered metals become quite reactive when at the high temperatures associated with the sintering zone of a sintering furnace, especially reactive with oxygen, the compacts are usually sintered in some type of protective atmosphere or in a vacuum. In some sintering applications, it is desirable to utilize a heated reducing atmosphere in the sintering zone that will chemically reduce and combine with impurities in the compact without harmfully affecting the metal undergoing sintering.

Sintering furnaces and sintering systems are of two general types, batch and continuous. For small operations and stringent control of process parameters, batch type furnaces are presently preferred. In situations demanding economies of time and labor and fixed temperature distribution, a continuous sintering furnace is presently preferred.

Continuous sintering furnace systems generally comprise at least three connected chambers, conveying means for transporting workpieces to be sintered through the system, and means for introducing a protective gas atmosphere in the sintering zone of the system. The first chamber is a preheat chamber where the workpieces enter the protective atmosphere of the system and where a significant amount of impurities are volatilized by the heat in the chamber. The temperature in this pre-heat chamber is significantly less than the sintering temperature required to sinter the workpieces. Heat is provided in the pre-heat chamber by the hot protective gas leaving the high temperature sintering chamber. The second chamber is the sintering chamber containing a sintering zone where the workpieces are brought up to and maintained at the sintering temperature by a suitable heating means. Typically, the heating means are electrical resistance heaters or gas combustion heaters, usually protected by some type of muffle. The third chamber is the cool-down chamber where the workpieces are cooled to a temperature fairly near ambient temperature before coming into contact with the external atmosphere. In many situations, the cool-down chamber is water jacketed to provide for a faster cooling of the workpieces.

Protective atmosphere systems for a continuous sintering furnace system are by necessity open systems as compared to closed systems, since it is generally impractical to provide a tight seal at the entrance and exit for the workpieces and still allow easy passage of the workpieces. Therefore the protective gas is usually introduced in the sintering zone and allowed to flow from the sintering zone of the system out both the entrance and exit of the furnace. These gases perform essentially two functions in the sintering operation. They exclude oxygen and other contaminants that are present in the ambient air from contacting the workpieces during the sintering operation and carry away the impurities that are volatilized or driven off from the workpieces. The first function can be characterized as a protective function and the second as a purging function.

The protective function prevents the workpieces from coming in contact with air while in the sintering zone and thereby helps to prevent oxidation of the workpieces. The higher pressure of the protective gas prevents air from backflowing into the sintering furnace system through the entrance and exit for the workpieces.

The purging function is to sweep away volatilized impurities to the external atmosphere so as to prevent a build-up of gaseous impurities in the sintering furnace system. To insure an even distribution of purging flow through both entrance and exit, the gases are usually introduced near the center of the sintering chamber. Thus as trapped gases are expelled from the workpieces and impurities volatilized, they are swept out of the furnace through the entrance and exit by the purging flow of the protective gas.

While the workpieces are at the sintering temperature, contact with impurities in the purging flow provides no significant problems since the impurities will be revolatilized, but as the workpieces cool down when reaching the cooling chamber, they are quite reactive to impurities bing swept out the exit until the workpieces reach near ambient temperatures. Reaction with the impurities in the purging flow may cause undesirable deposits on the surfaces of the workpieces which may harmfully effect their ultimate function.

Impurities in the purge flow out the entrance of the workpieces contacting the workpieces present no meal problem of contamination since the impurities will be revolatilized from the workpieces by the high temperature of the sintering chamber.

Thus a problem of conventional continuous sintering furnace system is that impurities are continually being flushed out the exit past the workpieces in the cooling chamber as the workpieces cool, the point at which the workpieces are most reactive to the impurities.

Means for conveying the workpieces through the furnace chambers can be classified generally into three types; roller drive pusher and wire mesh continuous belt. Roller drive conveying means consists of a series of powered rollers which propel workpieces through the furnace, the workpieces usually being in boats. Although able to carry relatively heavy loads, such conveying means are not able to withstand high sintering temperatures. Pusher type conveying means utilizes boats or the like for carrying workpieces and they are pushed through the furnace by pressure from the boat or boats just entering the furnace. Pusher type conveying means are prone to buckle in operation and cause jamming of the boats within the furnace. Wire mesh type conveying means are a continuous belt fabricated from metal wires attached to each other in an open mesh type pattern. Wire mesh types are not able to carry heavy loads due to stretching of the belt when in the high heat zone of the furance and are generally unable to withstand high sintering temperatures due to the properties of the metal wire. There is also a tendency for some types of workpieces to stick to the mesh belt due to the metal to metal contact during sintering causing contamination which is avoided in the other two types by the use of boats.

Thus all three types of conveying means may have inherent disadvantages for transporting workpieces through the sintering furnace system depending on the application, especially their inability to withstand high sintering temperatures and causing contamination of the work load.

It is therefore a feature of the present invention to provide a conveying means, a sintering furnace and sintering system that can withstand high sintering temperatures. Another feature of the present invention is to provide a conveyor means having construction that helps to minimize the problem of contaminating and sticking of the workpieces by the conveying means. Yet another feature of the present invention is that the sintering furnace and system have the protective atmosphere introduced as to reduce the recontamination during the cooling of sintered workpieces. Another feature of the present invention is to provide a sintering furnace and system that have the protective gas atmosphere introduced to help speed the cooling of the sintered workpieces.

The forgoing features and advantages of the present invention will be more clearly understood when considered in conjunction with the accompanying drawing in which.

Generally, the invention comprises a sintering furnace and system with means for introducing the protective atmosphere so as to substantially purge impurities generated during sintering in a direction opposite to the movement of workpieces in the sintering zone and a solid continuous refractory metal belt for transporting workpieces through the sintering zone. More specifically, the sintering furnace system includes protective atmosphere ejection ports at selected locations in the furnace chambers to provide countercurrent flow of the gas in that portion of the system where a majority of the impurities are evolved during sintering of the workpieces.

Another embodiment of the invention comprehends utilizing a plurality of sintering furnace chambers in the sintering system with ejection ports for ejecting a protective gas arranged so as to provide a countercurrent gas flow in the area of the system where a majority of impurities are volatilized. The sintering furnace system also includes a continuous refractory metal belt with notched retaining walls for conveying workpieces through the sintering chambers.

The invention will be further illustrated in connection with the process of sintering tantalum compacts for use as anodes in electrolytic capacitors. It should be understood, however, that the invention is shown in this particular manner for the purposes of illustration only and that the invention is not intended to be limited to the specific illustrated embodiments.

Figure 1:
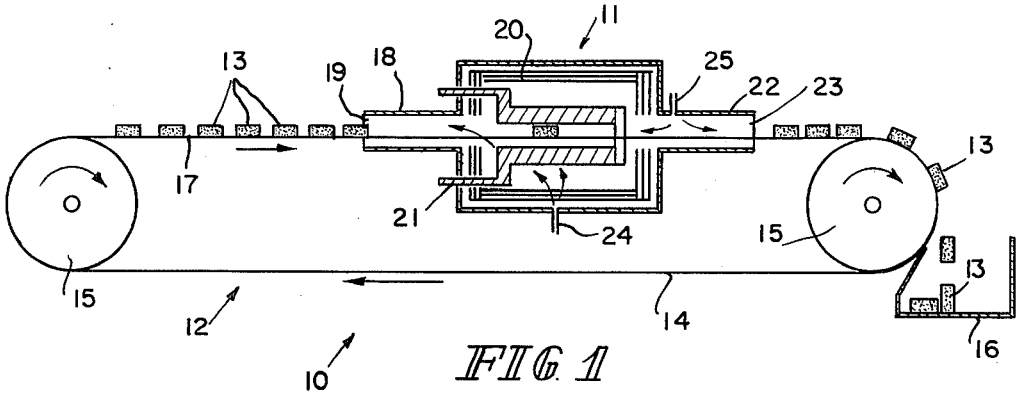
FIG. 1 is a side view of a sintering furnace and system with the furnace portion in cross section.

Referring now to the drawings, FIG. 1 is a cross-sectional view of a horizontal sintering furnace system 10 for sintering tantalum compacts. The system 10 includes furnace 11 and conveying means 12. Illustrated moving through the system 10 are tantalum workpieces 13. The conveying means 12 includes continuous solid metal belt 14, drive means 15, and collecting means 16. During operation of the sintering furnace system 10, belt 14 moves in the direction as indicated by the arrows by the motion imparted by the drive means 15. Tantalum workpieces 13 are loaded by any suitable means (not shown) on the belt 14 in the area 17. The workpieces 13 pass first into the pre-heat chamber 18 of the furnace 11 through entrance 19 where the workpieces are heated to a temperature somewhat below sintering temperature. The workpieces 13 then pass into the sintering chamber 20 where they are heated to sintering temperature by heating means 21. The sintered workpieces 13 then pass through the cooling chamber 22 and out exit 23 where the workpieces are separated from the belt 14 and are deposited in collecting means 16.

A protective gas atmosphere (not shown) is introduced to the sintering furnace 11 through gas ejection ports 24 and 25. The protective gas flows out of the furnace at entrance 19 and exit 23 and thereby helps minimize the external atmosphere (not shown) from backflowing into the furnace through the entrance and exit and contacting the workpieces 13 during sintering.

By utilizing two gas ejection ports 24 and 25 for ejecting the protective gas in the location shown in FIG. 1, impurities volatilized from the workpieces 13 in the pre-heat chamber 18 and sintering chamber 20 are carried out by the gas flow from inlet 24 through entrance 19, countercurrent to the movement of the workpieces. Such a flow of impurities is possible since most impurities are volatilized in the preheat chamber 18 and the entrance portion of the sintering chamber 19. The protective gas flowing from ejection port 25 helps to minimize the flow of gas from gas ejection port 24 from exiting the furnace 11 through exit 23 and provides a substantially uncontaminated protective gas atmosphere for the workpieces 13 as they pass through the cooling chamber 22. As the sintered workpieces 13 are cooled in the cooling chamber 22 they are reactive to impurities carried in the protective atmosphere and, therefore, a substantially uncontaminated protective gas is required during this portion of the sintering operation. The flow of the gases from gas ejection ports 24 and 25 is shown schematically by the broken arrows in FIG. 1.

The introduction of protective gas from gas ejection port 25 also sufficiently dilutes any of the gas ejected from gas ejection port 24 that is carrying impurities from the sintering chamber which is able to flow out the cooling chamber 22 to exit 23. The dilution of any impurities in this stream effectively minimizes any significant recontamination of the workpieces 13 as they are in the process of cooling.

The introduction of protective gas from gas ejection port 25 near the entrance to the cooling chamber 22 provides an additional advantage to the overall sintering process. This gas helps to cool the workpieces 13 since the gas has not gone through the hot zone of the sintering chamber 20 as has the gas from gas ejection port 25. By cooling the workpieces 13 faster, they do not remain as long in the temperature range where they are particularly reactive to any contaminants in the protective atmosphere.

In the sintering of tantalum compacts for use as capacitor anodes, once the sintered compacts are cooled to about 300° C. they are no longer sufficiently reactive with the contaminants to be able to form harmful deposits. Thus, the faster the sintered compacts are cooled to such a temperature, the less time there is for them to react with any contaminants present.

The net result of such a configuration of gas ejection port for the introduction of protective gases to the furnace is that volatilized impurities given off by the workpieces 13 upon the application of heat, are substantially carried out through entrance 19 while uncontaminated gas from gas ejection port 25 helps to protect the workpieces as they cool in cooling chamber 22. Any impurities carried out through exit 23 are sufficiently diluted by the protective gas from gas ejection port 25 so as to not harmfully affect the workpieces 13.

Protective gases typically used in sintering furnace systems are reducing gases such as hydrogen or cracked ammonia or inert gases such as helium or argon. For the sintering of tantalum pellets for capacitor anodes, only inert gases such as argon can be used.

Figure 2:
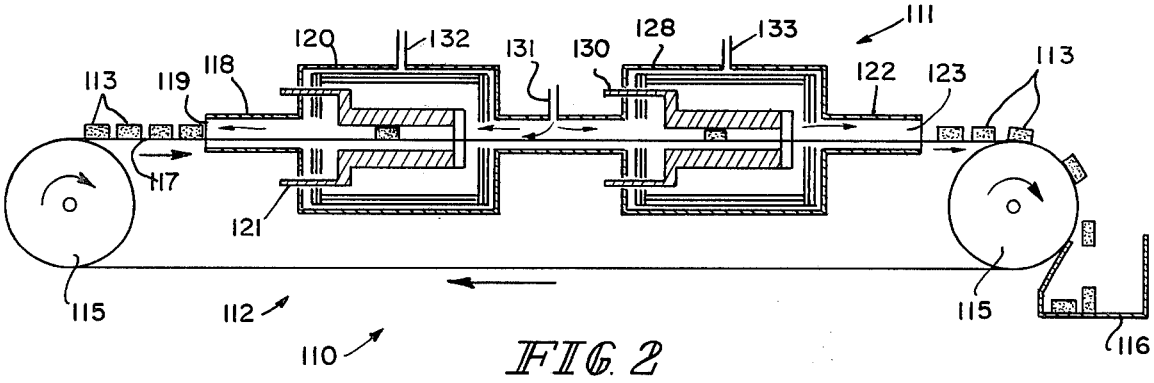
FIG. 2 is a side view of another embodiment of a sintering furnace and system with the furnace portion in cross section.

FIG. 2 illustrates another embodiment of the present concept for providing a substantially uncontaminated protective gas during the final portion of the sintering step and during the cooling of the sintered workpieces. Here sintering furnace system 110 comprises furnace means 111 and conveying means 112. Conveying means 112 comprises metal belt 114, drive means 115 and collecting means 116. Workpieces 113 are loaded on belt 114 in the area of point 117, conveyed through sintering furnace means 111 and deposited in collecting means 116. The direction of travel of belt 114 is indicated by arrows near the belt.

Furnace means 11 includes a pre-heat chamber 118 with workpiece entrance 119, sintering chambers 120 and 128 and with heating means 121 and 130 respectively, connecting chamber 129 between sintering chambers 120 and 128, and cooling chamber 122 with workpiece exit 123. Protective gas (not shown) is introduced to the furnace means 111 through gas ejection port 131 and leaves through entrance 119 and exit 123 as is shown schematically by the broken arrows on the drawing.

Workpieces to be sintered 113 enter the furnace means 111 at entrance 119 and pass into pre-heat chamber 118. The workpieces are heated by the gases leaving the furnace means 111 from the high temperature sintering chamber 120. As trapped gases and other impurities are volatilized from the workpieces 113, they are carried out of the furnace means 111 by protective gas stream which leaves at entrance 119. Any impurities volatilized when the workpieces 113 reach the sintering chamber 120 are carried counter to the movement of the workpieces, thereby helping to insure that impurities are not brought into contact with the workpieces after they have been through the first sintering chamber 120.

By the time the workpieces 113 reach the second sintering chamber 128, a majority of the impurities in the workpieces will have been removed and any that remain are sufficiently diluted by the fresh stream of protective gas flowing towards exit 123. After cooling in the cooling chamber 122 and leaving the furnace means 111 through exit 123, the workpieces 113 are deposited in collecting means 116, ready for further processing steps.

One, two, or more additional gas ejection ports, 132 and 133, may be utilized with gas ejection port 131 to help purge chambers 120 and 128 by creating additive gas mixing in the sintering chambers which mixing appears to facilitate removal of evolved impurities. The gas ejection ports 132 and 133 are not required for operation but may be used in some situations if additional safeguards are desired so long as the basic flow pattern is not changed.

Although the sintering furnace system of FIG. 2 contains two sintering furnace chambers, it is contemplated that additional sintering chambers could be connected in series with the two chambers shown. Such an arrangement would provide additional safeguards against recontamination of the workpieces during the sintering process.

Figure 3:
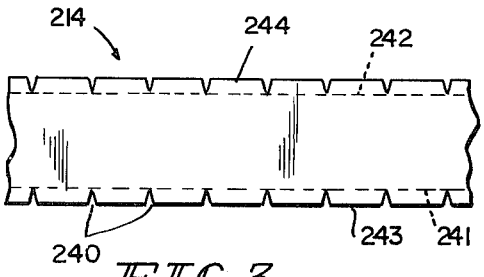
FIG. 3 is a top view of a portion of a strip of metal to be used in the fabrication of the conveying means of this invention.

FIG. 3 is a top view of a portion of the continuous belt (14 in FIG. 1 and 114 in FIG. 2) before it is formed into its final configuration. The belt section 214 is provided with a plurality of notches 240. The dashed lines 241 and 242 indicate where the belt is bent to provide parallel spaced apart retaining walls 243 and 244 so as to help prevent workpieces (not shown) from rolling or falling off of the side of the belt prior to or during the sintering operation. The plurality of notches 240 allow the belt 214 to pass over the drive means (not shown) without harmful stresses on the retaining walls 243 and 244 of the belt. Notches 240 may be of any shape but the V-shaped notches as shown are preferred because of ease of fabrication.

It should be noted that the retaining walls 243 and 244 do not necessarily have to be formed by bending the edges of the belt but may be formed by attaching separate strips to the belt. Notches could be made in the retaining walls either before or after attachment. However, bending of the edges of the belt is a preferred method of fabrication because of economies of time and labor.

The retaining walls 243 and 244 should be notched at regular and short intervals. The spacing of the notches 240 may be varied according to the diameter of the drive means. For larger diameter drive means, larger spacings may be used between the notches without adverse effect and conversely, smaller spacings will be required when smaller drive means are used. A preferred range for spacing of the notches is from about $\frac{1}{8}$ inch to about 1 inch.

The belt 214 is composed of a thin strip of metal, preferably a refractory metal such as tantalum, and the two ends (not shown) welded together to form a continuous loop. Refractory metals are preferred materials for the belt 214 since they are able to withstand the high temperatures of sintering without a severe adverse affect on physical properties such as mechanical strength. Tantalum is most preferred for the sintering of tantalum compacts for use as anodes in capacitors since there is minimal metal-to-metal contamination of the tantalum compacts from a tantalum belt.

The thickness of a tantalum belt 214 may vary from about 0.003 inches to about 0.020 inches, with the preferred thickness being from about 0.005 inches to about 0.010 inches.

Preferably, the belt 214 should be conditioned by annealing by passing it through the furnace means (not shown) without a load so as to minimize the sticking of workpieces to the belt. Tantalum metal is not as subject to as much embrittlement as other refractory metals under high temperature use and therefore as a belt can be used with smaller drive means and has a longer useful life.

Figure 4:
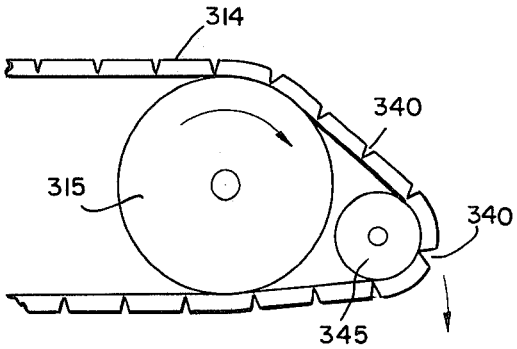
FIG. 4 is a side detail view of another embodiment of a portion of the conveying means and drive means.

FIG. 4 is a side view of another embodiment of the drive means located after the furnace shown along with a notched belt conveying means. Main drive means 315 powers belt 314 which contains notches 340. A smaller diameter idler drive means 345 provides a greater bending or flexing action of the flat portion of belt 314 so as to dislodge any workpieces (not shown) that may have become slightly stuck to the blet during the sintering operation. Collecting means (not shown) may be located below the idler means 345 so as to catch the workpieces as they fall off the belt 314 in the direction of the arrow.

Thus the invention as disclosed herein comprehends continuous sintering furnace systems with protective gas inlet means that provide a countercurrent flow for expulsion of impurities produced in the sintering process and with a solid refractory metal conveying means that is able to withstand high temperatures, eliminates the use of boats or other carrying means and has a resistance to sticking and contamination between the workpieces and the conveying means.

While the present invention has been described with reference to particular embodiments thereof, it will be understood that numerous modifications may be made by those skilled in the art without actually departing from the spirit and scope of the invention as defined in the appended claims.

I claim:

1. A continuous sintering furnace system comprising:

(a) entrance and exit sections, (b) a preheat chamber communicating with said entrance section, (c) a first sintering chamber adjacent to and communicating with said preheat chamber, (d) a connecting chamber connecting said first sintering chamber with a second sintering chamber, (e) a cooling chamber adjacent to said second sintering chamber and communicating with it and said exit section, (f) heating means disposed in said first and second sintering chambers, (g) conveyor means carrying workpieces through said entrance section, said chambers, and said exit sections, and (h) gas inlet means communicating with said first and second sintering chambers near their central portions, and a gas inlet means communicating with said connecting chamber substantially midway between said first and second sintering chambers, whereby there is a continuous gas flow toward both said entrance and exit sections.

2. The furnace system of claim 1, wherein the conveyor means is a continuous belt comprising a refractory metal strip with ends connected to form a loop, and notched integral retaining walls substantially perpendicular to the strip, the retaining walls helping to retain the workpieces carried by the conveyor means on the conveyor means during sintering.

3. The furnace system of claim 2, wherein the entrance and exit are open during sintering.

4. The furnace system of claim 3, including means for removing sintered workpieces from the conveyor means.

* * * * *